US006694531B2

(12) United States Patent
Arai

(10) Patent No.: US 6,694,531 B2
(45) Date of Patent: Feb. 24, 2004

(54) FULL-FACE HELMET

(76) Inventor: Michio Arai, c/o Arai Helmet, Ltd., 12 Azuma-cho 2-chome, Saitama-shi, Saitama-ken (JP)

( * ) Notice: Subject to any disclaimer, the term of this patent is extended or adjusted under 35 U.S.C. 154(b) by 0 days.

(21) Appl. No.: 10/043,196

(22) Filed: Jan. 14, 2002

(65) Prior Publication Data

US 2002/0092087 A1 Jul. 18, 2002

(30) Foreign Application Priority Data

Jan. 15, 2001 (JP) ..... 2001-006866
Jan. 17, 2001 (JP) ..... 2001-009101

(51) Int. Cl.[7] ..... A42B 1/08
(52) U.S. Cl. ..... 2/424; D29/107
(58) Field of Search ..... 2/410, 424, 9, 2/425, 6.1, 6.3, 6.4, 6.7, 423; D29/106, 107

(56) References Cited

U.S. PATENT DOCUMENTS 2,935,985 A * 5/1960 Andrews et al. ..... D29/107
D193,761 S * 10/1962 Griffiths ..... 2/9
3,149,632 A * 9/1964 Colley ..... 2/6.3
3,216,023 A * 11/1965 Morgan ..... 2/9
3,548,410 A * 12/1970 Parker ..... 2/424
4,042,974 A * 8/1977 Morgan et al. ..... 2/9
4,689,836 A * 9/1987 Vitaloni ..... 2/424
5,263,204 A * 11/1993 Butsch ..... 2/424
5,421,035 A * 6/1995 Klose et al. ..... 2/411
5,655,227 A * 8/1997 Sundberg et al. ..... 2/414
6,035,451 A * 3/2000 Burns et al. ..... 2/424
6,295,653 B1 * 10/2001 Puleo ..... 2/424
6,442,767 B1 * 9/2002 Meckes et al. ..... 2/424

FOREIGN PATENT DOCUMENTS

FR 2546381 A1 * 11/1984 ..... A42B/3/32
JP 0699844 12/1994

* cited by examiner

*Primary Examiner*—Rodney M. Lindsey
(74) *Attorney, Agent, or Firm*—Dykema Gossett PLLC

(57) ABSTRACT

A full-face helmet having a fundamental structure of the full-face helmet as well as a function of protection and showing an identification of face, convenience in use of it and a high visibility in field of view as formed in a half type, three-quarters type, or an open face type helmet. There is provided a full-face helmet for a motorcycle in which a chin guard integrally formed with the helmet is provided and the helmet has a shield that can be opened or closed, wherein a window hole opened at a front surface of a shell made of fiber reinforced resin material or thermoplastic resin material or the like is opened in a range in which a substantial entire face ranging from brows to the chin of the wearing person can be confirmed when the window hole is seen from an outside part of the front surface of the helmet under a state in which the head part of a wearing person is kept upright.

9 Claims, 3 Drawing Sheets

FULL-FACE HELMET

BACKGROUND OF THE INVENTION

1. Field of the Invention

This invention relates to a full-face helmet where a driver wears it in order to protect the head and the face when the driver rides on a motorcycle.

2. Description of the Related Art

The helmet must be taken off every time the driver takes food or smokes, almost of all the face is covered by the helmet to cause identification of the face to be hardly attained, resulting in that there is present a case, for a sake of anti-theft protection in recent years.

In turn, in the case of a half type, three-quarters type or an open face type helmet, since the substantial entire face is exposed out, the aforesaid matter is not generated, although it can be denied that the function of protection against the chin is lower as compared with that of the full-face helmet.

At present, there is a system helmet in which the chin guard is opened or closed together with the shield and substantial entire face of the driver is exposed under the opened state of it.

Further, since it is necessary to provide the structure in which the chin guard is rotatably supported against the shell, its weight is increased by the supporting structure and this increased weight causes the balance in the system to be collapsed and further the chin guard and the shell are not integrally assembled, so that it is not denied that the function of protection at the chin is low as compared with that of the usual full-face helmet.

SUMMARY OF THE INVENTION

In view of the foregoing, it is an object of the present invention to provide a full-face helmet having a fundamental structure of the full-face helmet as well as a function of protection and showing an identification of face, convenience in use of it and a high visibility in field of view as formed in a half type, three-quarters type or an open face type helmet.

The technical means employed by the present invention to accomplish the aforesaid object provides a full-face helmet A for a motorcycle in which a chin guard 1 integrally formed with the helmet is provided and the helmet has a shield 2 that can be opened or closed, wherein a window hole 4 opened at a front surface of a shell 3 made of fiber reinforced resin material or thermoplastic resin material or the like is opened in a range in which a substantial entire face B ranging from brows B2 to the chin B3 of the wearing person can be confirmed when the window hole 4 is seen from an outside part of the front surface of the helmet under a state in which the head part B1 of a wearing person is kept upright. (claim 1)

In accordance with the invention defined in claim 1, the face of the helmet wearing person ranging from the brows B2 at the face B to the chin B3 is exposed out of the window hole 4 under a state in which the person wears the full-face helmet A.

Since the chin guard 1 and the shell 3 are integrally assembled, a fundamental structure of the full-face helmet as well as its protecting function are assured.

Accordingly, under the state in which the person wears the full-face helmet A having the fundamental structure and the protection function, it is possible to cause another person to acknowledge the face B of the helmet wearing person in the same manner as that of an open face type, a half type, or three-quarters type helmet and further the wearing person can smoke, eat or drink.

Further, since a driver's field of view in a downward direction is attainable like those of wearing the open face, a half type or three-quarters type helmet.

DESCRIPTION OF THE PREFERRED EMBODIMENT

Figure 1:
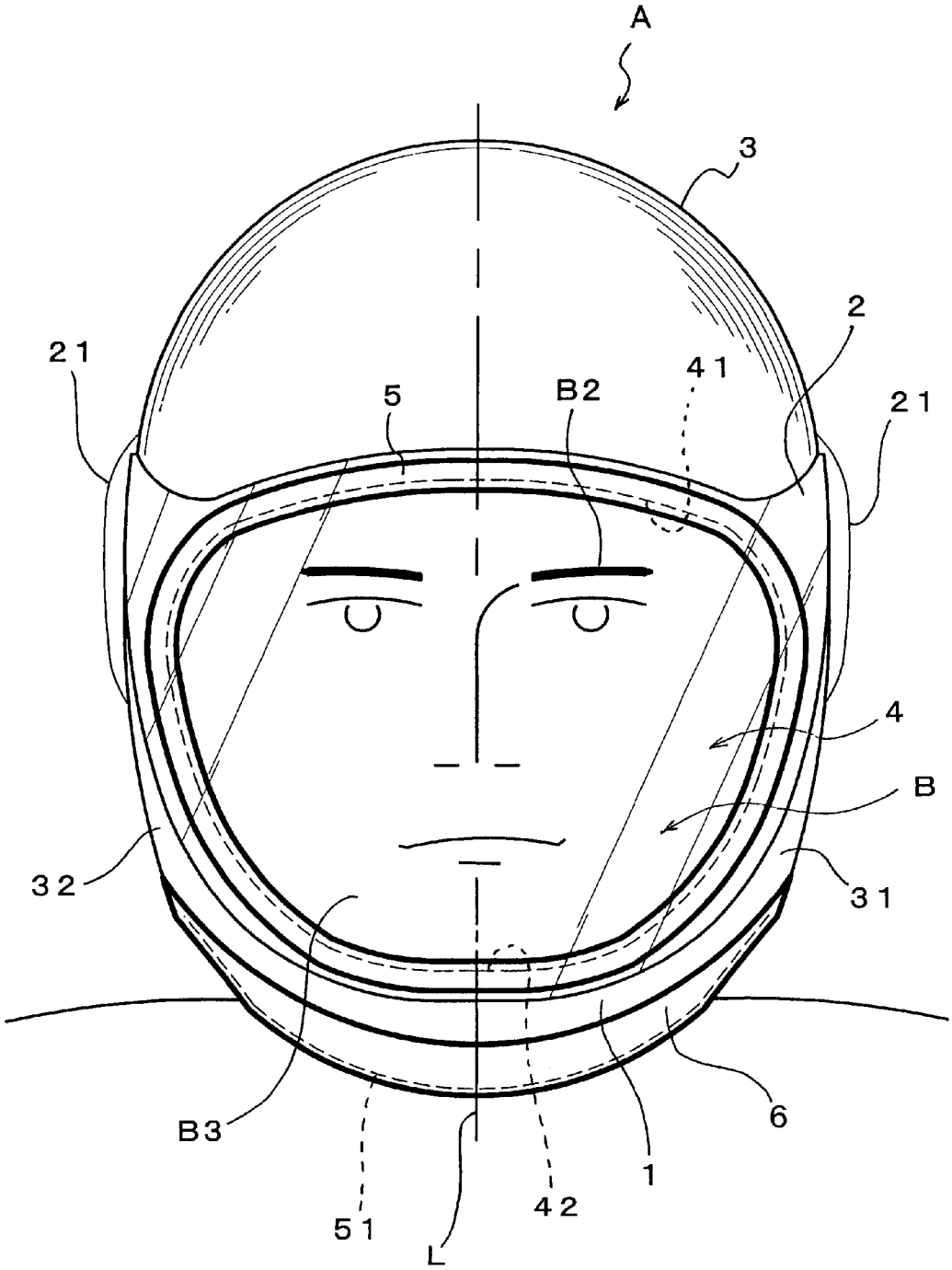
FIG. 1 is a front elevational view for showing the full-face helmet of the present invention.

The full-face helmet of the present invention is directed to an on-road type helmet used when a usual rider runs on a public road except for an auto-bicycle racing or an off-road riding.

Setting a size of the full-face helmet A of the present invention to that size normally applied in the helmet enables its object to be accomplished without applying any irregular feeling to a wearing person when the driver wears it.

A standard size of the full-face helmet normally used at present shows that the maximum length from the upper edge of the window hole to the lower edge of the chin guard section is about 170 mm to 190 mm and the maximum circumferential length of the shell at the surface above the window hole is about 800 mm to 910 mm.

Although a range where the substantial entire face B can be confirmed shows a certain difference individually for every individual wearing person, it is at least about 130 mm or more and more preferably, if it shows about 140 mm to 150 mm, the present invention can be adapted for many unidentified wearing persons.

The window hole in the full-face helmet normally used has the maximum opening width where a range from one location near the brows of the usual wearing person to the other location slightly below the eyes can be seen and in reference to its rate, it is the maximum opening width ranging from about 55% to about 58% against the maximum length ranging from the upper edge of the window hole to the lower edge of the chin guard section on the vertical center line at the front surface of the shell except the accessories installed at the shell.

In the present invention, the maximum opening width (b) in the vertical direction ranging from the upper edge 41 of the window hole 4 to its lower edge 42 in respect to the maximum length (a) ranging from the upper edge 41 of the window hole 4 to the lower edge 51 of the chin guard 1 on the vertical center line L at the front surface of the shell 3 except the accessories installed at the shell 3 is set to 75% or more, the opening width of the window hole 4 is set to a range where a substantial entire face B can be confirmed (claim 2).

In the case that the full-face helmet of standard size described above is used, a rate of the maximum opening width (b) against the aforesaid maximum length (a) is determined within a range of 75% or more in such a way that the maximum opening width of the window hole 4 becomes about 140 mm to 150 mm. However, if the full-face helmet A has the maximum length (a) of 170 mm, setting of the rate to about 82.4% causes the maximum opening width (b) to become about 140 mm, so that it is possible to confirm an entire face B under the state where the driver wears it.

Further, in the present invention, the maximum opening width (b) in the vertical direction ranging from the upper edge 41 of the window hole 4 to its lower edge 42 in respect of the maximum length (a) ranging from the upper edge 41 of the window hole 4 to the lower edge 51 of the chin guard 1 on the vertical center line L at the front surface of the shell 3 except the accessories installed at the shell 3 is set to 75% or more, and the minimum width (c) in the vertical direction ranging from the lower edge 42 of the window hole 4 to the lower edge 51 of the chin guard 1 is set to a value lower than 36% of the aforesaid maximum opening width (b), thereby the opening width of the window hole 4 is set to a range where the substantial entire face B can be confirmed (claim 3).

The minimum width (c) of the chin guard 1 is about 30 mm to 50 mm in a range where a strength of the chin guard 1 can be assured.

Figure 2:
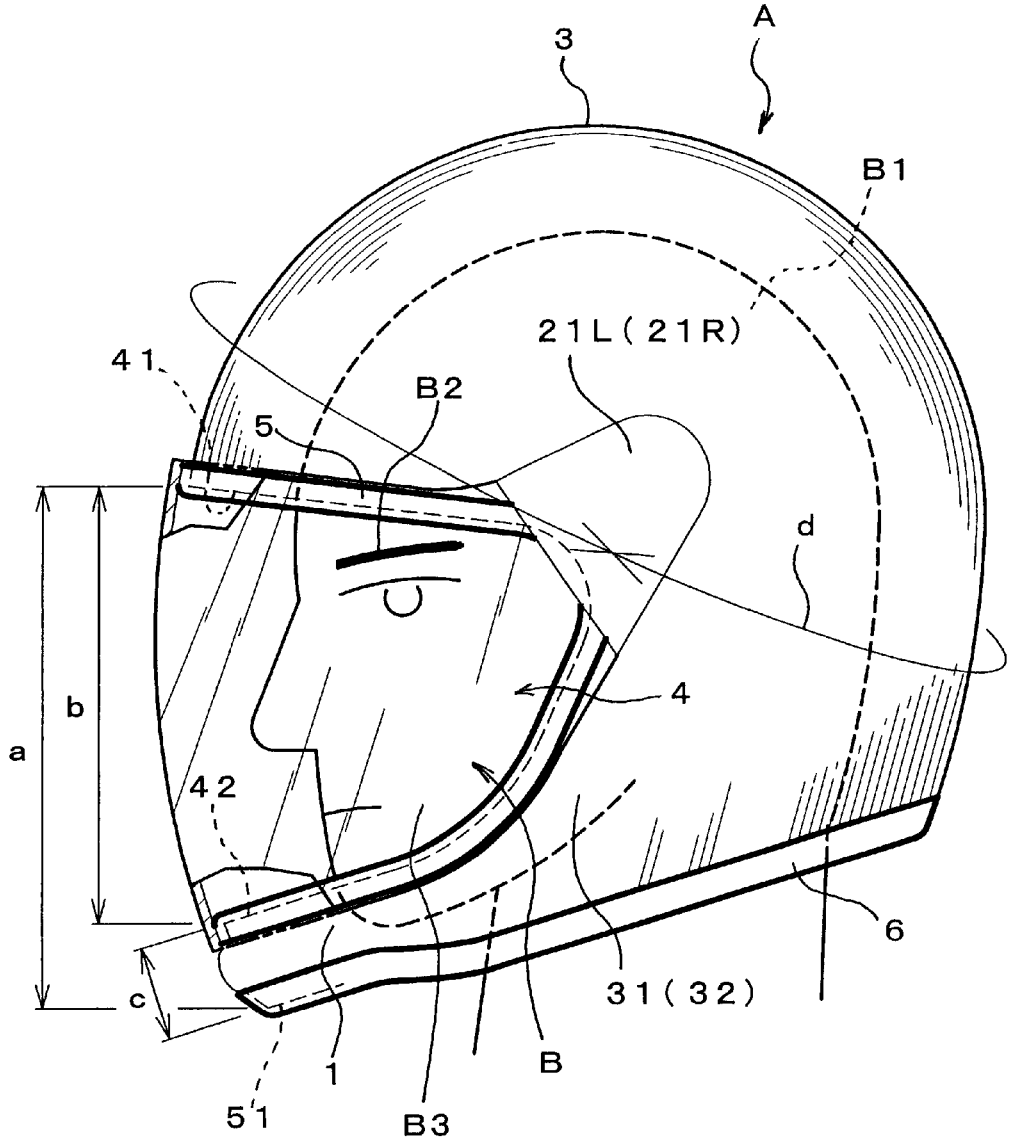
FIG. 2 is a side elevational view for showing the full-face helmet of the present invention.

The minimum width (c) of the chin guard is, as shown in FIG. 2, a width where the chin guard 1 is seen from the opposite direction and a sum of the minimum width (c) and the maximum opening width (b) is not necessarily the same length as the aforesaid maximum length (a) in accordance with an arranging angle of the chin guard 1.

For example, in the case that a driver wears the aforesaid full-face helmet of a standard size, a rate of the maximum opening width (b) in respect to the aforesaid maximum length (a) is determined within a range of 75% or more in such a way that the maximum opening width of the window hole 4 may become about 140 mm to 150 mm and the minimum width (c) is determined within a range of 30 mm to 50 mm and further determined in a range where the rate of the minimum width (c) in respect to the maximum opening width (b) is in a range lower than 36% in such a way that the position of the lower edge 51 of the chin guard 1 may not exceed the aforesaid maximum length (a).

Accordingly, also in accordance with claim 3, the substantial entire face B can be confirmed under a state in which a driver wears the helmet and a strength of the chin guard 1 can be assured.

In order to attain a more positive assuring of the chin guard 1, the present invention has means for assuring a strength of the chin guard 1 itself and realizing a function to protect the chin by constructing a rib structure in which a circumferential surface of the chin guard 1 is curved over its entire length and in a direction protruding outwardly on the sectional surface of the shell. (claims 4–6)

In accordance with the invention described in claims 4–6, some numerical values adapted for the Snell Standard have been confirmed as a result of performing a test for the chin guard 1 in reference to the method described below.

The testing method is performed in reference to the chin guard test E5 of the Snell Standard M2000.

More practically, the helmet is tightly fixed to a rigid base plate in such a way that the chin guard is faced upward and a reference plane occupies an angle of 65±5° inclined from the horizontal line.

Then, the helmet should have a feature that a downward maximum flexing amount of the chin guard does not exceed 60 mm and any type of accessories do not provide any trouble against the helmet wearing person when a mass of 5±0.2 kg with a flat striking surface having a minimum area of 0.01 $m^2$ is dropped onto a center of the chin guard with a striking speed of 3.5±0.2 m/sec. under a guide dropping.

The full-face helmet applied in the test is one in which the width at the central part of the chin guard is 33 mm. As a result of aforesaid measurement performed by the testing method against this helmet, the maximum flexing amount was 38 mm and each of the components placed at each of the locations did not show any trouble damaging the helmet wearing person.

As to this result, this is caused by the fact that the width of the chin guard at its central part is 33 mm. However, in view of the maximum flexing amount in this chin guard, it may be assumed that the chin guard having the width at its central part less than this value can assure a requisite strength.

Further, although the gazette of Japanese Patent Publication Hei 6-99844 of the applicant has a proposal about the full-face helmet capable of reducing the width of the chin guard in its vertical direction to a value lower than a normal width by embedding a reinforcing member into the chin guard along the chin guard, the invention described in claims 4–6 can keep a requisite strength only with the raw material constituting the chin guard 1, so that the present invention is an invention having some specific superior effects not found in the full-face helmet proposed in the aforesaid gazette in that a light weight formation of the entire helmet and a cost reduction caused by reducing the component parts (auxiliary members) can be realized and the function of protection against the chin B can also be realized.

Figure 3:
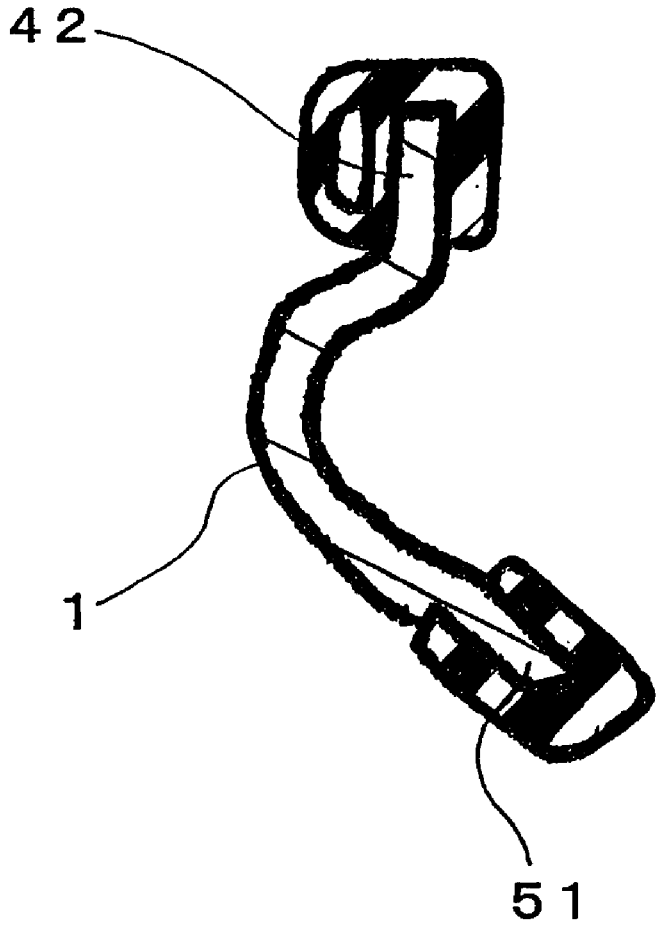
FIG. 3 is an enlarged view in longitudinal section only for showing the chin guard along a center line of FIG. 1.

Referring now to the drawings, the preferred embodiment of the present invention will be described as follows. FIGS. 1 to 3 illustrate the full-face helmet A in which the window hole 4 is opened in such a way that the substantial entire face B can be confirmed.

The full-face helmet A in the preferred embodiment of the present invention is constituted such that the front surface of the shell 3 having the chin guard 1 integrally formed with it under application of fiber reinforced resin material or thermoplastic resin material is provided with the window hole 4, there is provided a shield 2 for use in opening or closing the window hole 4, wherein the shell 3 has at its inner side a shock absorbing liner (not shown) constituted under application of expanded polystine stylofoam or raw material having the same shock absorbing performance as that of the former material and an inner liner (not shown) composed of cushion material represented by urethane material arranged inside the shock absorbing liner.

The window hole 4 is opened in a range in which the substantial entire face B of the helmet wearing person can be confirmed in a range from the brows B2 to the chin B3 when the window hole 4 is seen from the front outer side under a state in which the head B1 of the helmet wearing person is kept vertical.

The chin guard 1 is formed such that the right and left cheeks 31, 32 at the shell 3 are made narrow toward the extremity ends as viewed from side portions and it may bridge between the right and left cheeks 31, 32 in a state of the narrowest width from the extremity ends.

In addition, the chin guard 1 has a rib structure at its circumferential surface over a full length and curved in a direction projecting outwardly, its strength is assured by the rib structure to realize a requisite protection function against the chin B3 (refer to FIG. 3).

As to the assurance of the strength caused by the shape of this chin guard 1, it is proved by the aforesaid chin guard test for E5 of the Snell Standard M2000 on Helmet that the requisite strength can be assured.

The shield 2 is made of well-known raw material having such an area and a shape as one capable of closing the entire window hole 4, and the supporting structure for the shell 3 is of a well-known structure and its description will be eliminated.

Then, the maximum opening width (b) of the window hole 4 and the minimum width (c) of the chin guard 1 of the full-face helmet A of the preferred embodiment will be described.

A size of the full-face helmet A is set such that the maximum length (a) from the upper edge 41 of the window hole 4 to the lower edge 51 of the chin guard 1 on the vertical center line L at the front surface of the shell 3 except the accessories installed at the shell 3 is about 175 mm, and the maximum circumferential length (d) of the shell 3 at the surface above the window hole 4 is about 850 mm.

The maximum opening width (b) of the window hole 4 of the full-face helmet A ranging from the upper edge 41 of the window hole 4 to the lower edge 42 on the vertical center line L at the front surface of the shell 3 except the accessories installed at the shell 3 is 148 mm and its rate in respect to the aforesaid maximum length (a) is about 84.6%.

In addition, the minimum width (c) of the chin guard 1 ranging from the upper edge 41 of the window hole 4 to the lower edge 51 of the chin guard 1 on the vertical center line L at the front surface of the shell 3 except the accessories installed at the shell 3 is 33 mm and its rate in respect to the aforesaid maximum opening width (b) is about 22.3%.

Accordingly, in the case of the full-face helmet A of the preferred embodiment having the size commercially available at present, it is possible to confirm the substantial entire face B of the helmet wearing person, as shown in FIG. 1, from the outside part of the front surface of it and at the same time, it can have a function of protection against the helmet wearing person.

The accessories installed at the shell 3 are a shield 2, shield covers 21L, 21R, rim rubbers 5, 6 fixed to the circumferential edge of the window hole 4 and to a circumferential edge at the lower opening of the shell 3, and an air ventilation mechanism (not shown) installed at the head part of the shell 3.

In addition, the full-face helmet A of the present invention is not limited to the numerical values indicated in the preferred embodiment and it is satisfactory if the numerical values are within a range of the numerical values described in claims 2 and 3 where the substantial entire face B of the helmet wearing person can be confirmed from an outside part at the front surface.

As described above, the present invention may provide some effects that the face B of the helmet wearer can be confirmed against another person in the same manner as that of the open face, half type or three-quarters type helmet under a state in which the person wears the full-face helmet assuring the fundamental structure and the protection function, a mere raising of the shield enables the person to smoke and drink or eat and further a downward field of view is attainable like those of the open face, a half type or three-quarters type helmet.

In addition, in claims 4–6, the present invention has some effects that a requisite strength can be assured only with the raw material constituting the chin guard, so that a light-weight formation of the entire helmet and cost reduction caused by decreasing the number of component parts (the reinforcing members) can be realized and the function of protection for the chin B can be realized.

Accordingly, it is possible to provide a full-face helmet having a fundamental structure of the full-face helmet as well as a function of protection and showing an identification of face, a high visibility in field of view and convenience in use of it as formed in a half type, three-quarters type or an open face type helmet.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A full-face helmet for a motorcycle in which a chin guard integrally formed with the helmet is provided and the helmet has a shield that can be opened or closed, wherein a window hole opened at a front surface of a shell made of fiber reinforced resin material or thermoplastic resin material is opened in a range in which a substantial entire face ranging from brows to the chin of the wearing person can be confirmed when the window hole is seen from an outside part of the front surface of the helmet under a state in which the head part of a wearing person is kept upright.

2. A full-face helmet according to claim 1, wherein an opening width in a vertical direction ranging from an upper edge of the window hole to its lower edge in respect to a maximum length ranging from the upper edge of the window hole to a lower edge of the chin guard on a vertical center line at a front surface of the shell except accessories installed at the shell is set to 75% or more.

3. A full-face helmet according to claim 1, wherein an opening width in a vertical direction ranging from an upper edge of the window hole to its lower edge in respect to a maximum length ranging from the upper edge of the window hole to a lower edge of the chin guard on a vertical center line at a front surface of the shell except accessories installed at the shell is set to 75% or more, and a minimum width in the vertical direction ranging from a lower edge of the window hole to the lower edge of the chin guard is set to a value lower than 36% of said opening width.

4. A full-face helmet according to claim 1, wherein a strength of the chin guard itself is assured and a function to protect the chin is realized by constructing a ribstructure in which a circumferential surface of the chin guard is curved over its entire length and in a direction protruding outwardly on a sectional surface of the shell.

5. A full-face helmet according to claim 2 wherein a strength of the chin guard itself is assured and a function to protect the chin is realized by constructing a rib structure in which a circumferential surface of the chin guard is curved over its entire length and in a direction protruding outwardly on a sectional surface of the shell.

6. A full-face helmet according to claim 3, wherein a strength of the chin guard itself is assured and a function to protect the chin is realized by constructing a rib structure in which a circumferential surface of the chin guard is curved over its entire length and in a direction protruding outwardly on a sectional surface of the shell.

7. A full-face helmet according to claim 2, wherein said maximum opening width ranges from 140 to 150 mm.

8. A full-face helmet according to claim 7, wherein said maximum length ranges from 170 to 190 mm.

9. A full-face helmet according to claim 2, wherein said chin guard has a minimum width of 30 to 50 mm.

* * * * *